United States Patent [19]

O'Shaughnessy

[11] 4,242,831

[45] Jan. 6, 1981

[54] TOY APPARATUS WITH PHOTOEMISSIVE MOTOR CONTROL SYSTEM

[75] Inventor: John F. O'Shaughnessy, Staten Island, N.Y.

[73] Assignee: Ned Strongin Associates, Inc., New York, N.Y.

[21] Appl. No.: 54,016

[22] Filed: Jul. 2, 1979

[51] Int. Cl.[3] ..... A63H 17/00; A63H 33/00; H01H 47/24; F21K 2/00

[52] U.S. Cl. ..... 46/251; 46/248; 46/45; 46/1 R; 362/34; 250/361 C; 250/462; 361/175; 361/176

[58] Field of Search ..... 46/45, 256, 248, 249-263; 235/454, 103; 361/173-177; 250/361 C, 462; 273/DIG. 24; 362/34

[56] References Cited

U.S. PATENT DOCUMENTS

| | | | |
|---|---|---|---|
| 3,478,209 | 11/1969 | Feuer | 250/462 |
| 3,599,048 | 8/1971 | Olin | 361/173 |
| 3,621,356 | 11/1971 | On | 318/480 |
| 3,665,200 | 5/1972 | Zaubitzer | 361/175 |
| 3,961,183 | 6/1976 | Dubot et al. | 361/175 |
| 3,963,928 | 6/1976 | Zolner | 250/361 C |
| 4,038,552 | 7/1977 | Ciofalo | 250/462 |
| 4,081,729 | 3/1978 | Payne et al. | 361/176 |
| 4,086,723 | 5/1978 | Strawick | 362/34 |
| 4,177,405 | 12/1979 | Chapdelaine | 361/173 |

*Primary Examiner*—Gene Mancene
*Assistant Examiner*—Michael J. Foycik, Jr.
*Attorney, Agent, or Firm*—Edward F. Levy

[57] ABSTRACT

A toy apparatus with a photoemissive motor control system includes a chamber into which a phosphorescent member is placed, whereupon photoemission acts upon a photosensitive element to activate a motor control circuit for operation of a motor which drives the toy apparatus. An activation apparatus is provided, which includes a battery operated lamp for periodic re-energization of the phosphorescent member.

10 Claims, 6 Drawing Figures

FIG. 3
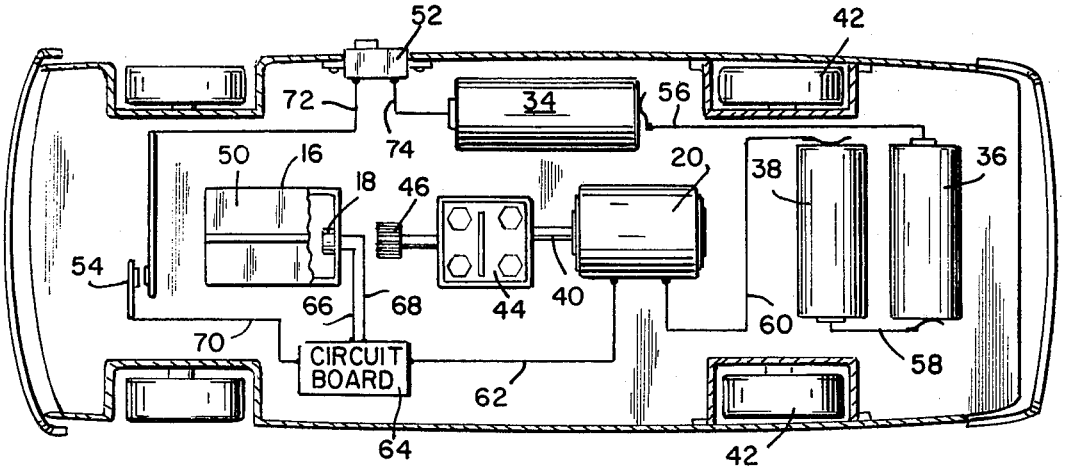
FIG. 5
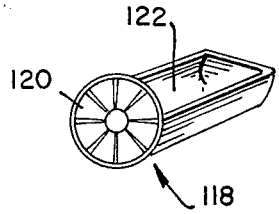
FIG. 4
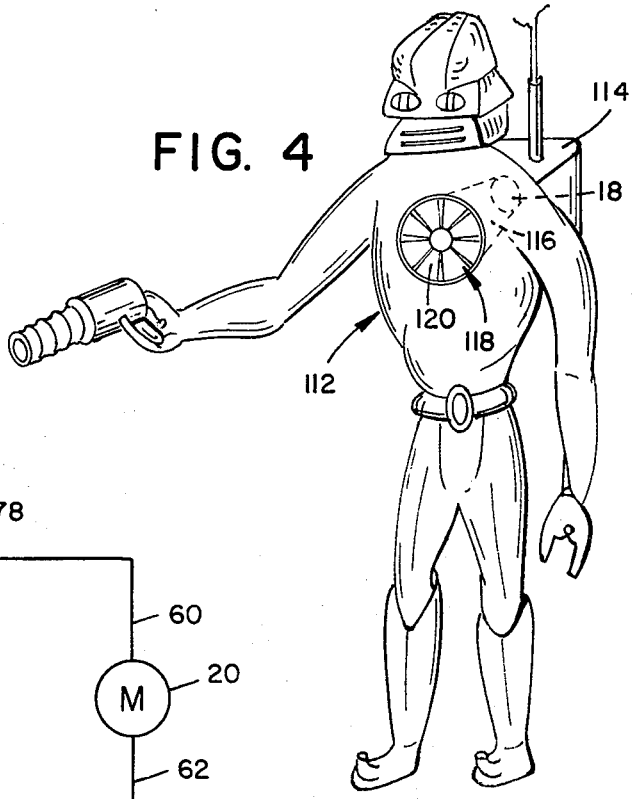
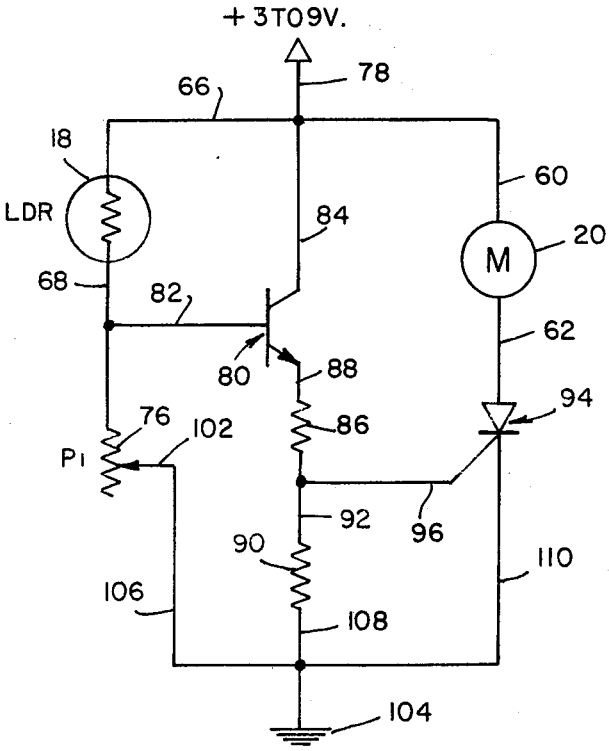
FIG. 6

TOY APPARATUS WITH PHOTOEMISSIVE MOTOR CONTROL SYSTEM

The present invention relates generally to the field of toys and more particularly to a motor driven toy which is activated by the insertion of a removable photoemissive member.

With the advent of increased interest in all forms of energy and especially atomic energy and solor energy, there has been an increased desire for toy apparatus which demonstrates the use of these forms of energy. This desire is coupled with a need for toy apparatus which is safe, relatively simple, low in cost and yet which provides a high degree of involvement for the child. These requirements preclude the use of actual radioactive devices, yet the desire for simulation of such devices remains.

Another result of the increased interest in all forms of energy has been an increased need for relatively simple, safe apparatus which can be used in schools to demonstrate the uses of energy and the conversion of energy from one form to another. This need is especially great in the areas of elementary education where the apparatus must be able to demonstrate the desired scientific principles yet be simple, rugged and safe enough for children to manipulate and play with.

It is an object of the present invention to provide a toy apparatus which is operated by means of a photoemissive member in a manner which simulates a radioaction powered device.

Another object of the present invention is to provide an apparatus which demonstrates the conversion of energy from light energy to electrical energy, and finally to mechanical energy.

Another object of the present invention is to provide a toy apparatus which provides extended play value through the simulation of the act of charging a member with energy, using the energy in the member until it has dissipated and then recharging the member to repeat the cycle.

Another object of the present invention is to provide a toy apparatus which operates using a phosphorescent block as an energy storage member.

Another object of the present invention is to provide a toy apparatus which may be safely operated by small children.

Still another object of the present invention is to provide a top apparatus which comprises a relatively small number of simple parts which are economical of manufacture.

In accordance with the present invention, there is provided a toy apparatus with a photoemissive motor control system which incorporates a chamber within which there is mounted a light dependent resistor. The light dependent resistor is connected via an electrical circuit to a source of direct current and to a motor in such a manner that a change in the resistance of the light dependent resister, caused by exposure to light, causes the motor to operate and drive the toy apparatus. A phosphorescent member is provided which may be charged by exposure to light, either from a battery operated lamp, which is provided, from sunlight, or from ambient room illumination. After being charged, the phosphorescent member is placed in the chamber causing the motor to operate. When the photoemission from the phosphorescent member drops below a predetermined value, the motor stops operating and the phosphorescent member must be recharged by re-exposure to light. This requirement for periodic recharging of the phosphorescent member extends the involvement of the child with the toy apparatus and increases its play value.

Additional objects and advantages of the invention will become apparent during the course of the following specification when taken in connection with the accompanying drawings, in which:

FIG. 3 is a bottom view of the toy automobile of FIG. 1 showing the internal arrangement of the various components;

FIG. 4 is a perspective view of a toy robot figure incorporating the photoemissive motor control system according to the present invention;

FIG. 5 is a perspective view showing the phosphorescent block chamber removed from the chest of the toy robot figure of FIG. 4; and, FIG. 6 is an electrical schematic diagram of the photoemissive motor control system according to the present invention.

Figure 1:
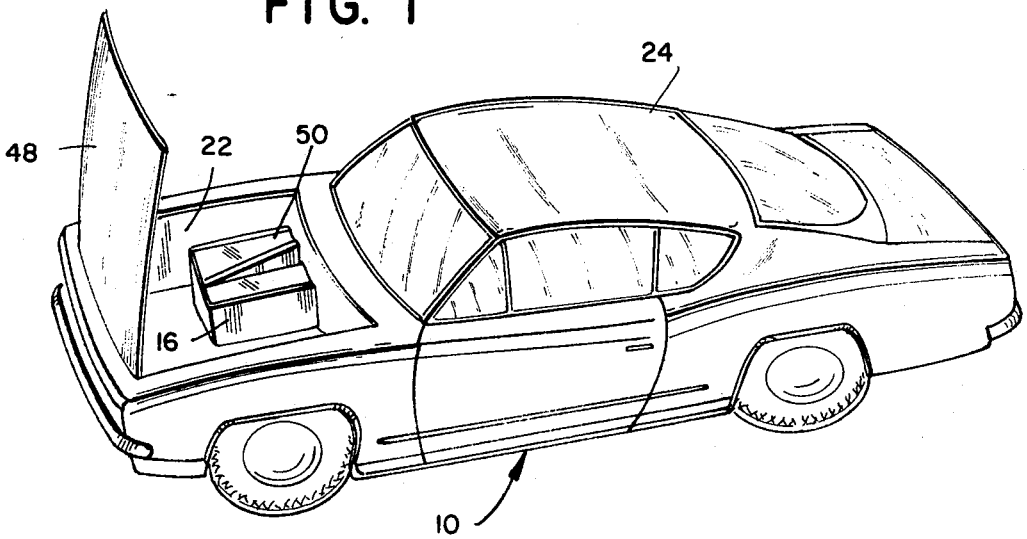
FIG. 1 is a perspective view of a toy automobile incorporating the photoemissive motor control system, according to the present invention, with the hood of the toy automobile shown open to reveal details of internal construction.
Figure 2:
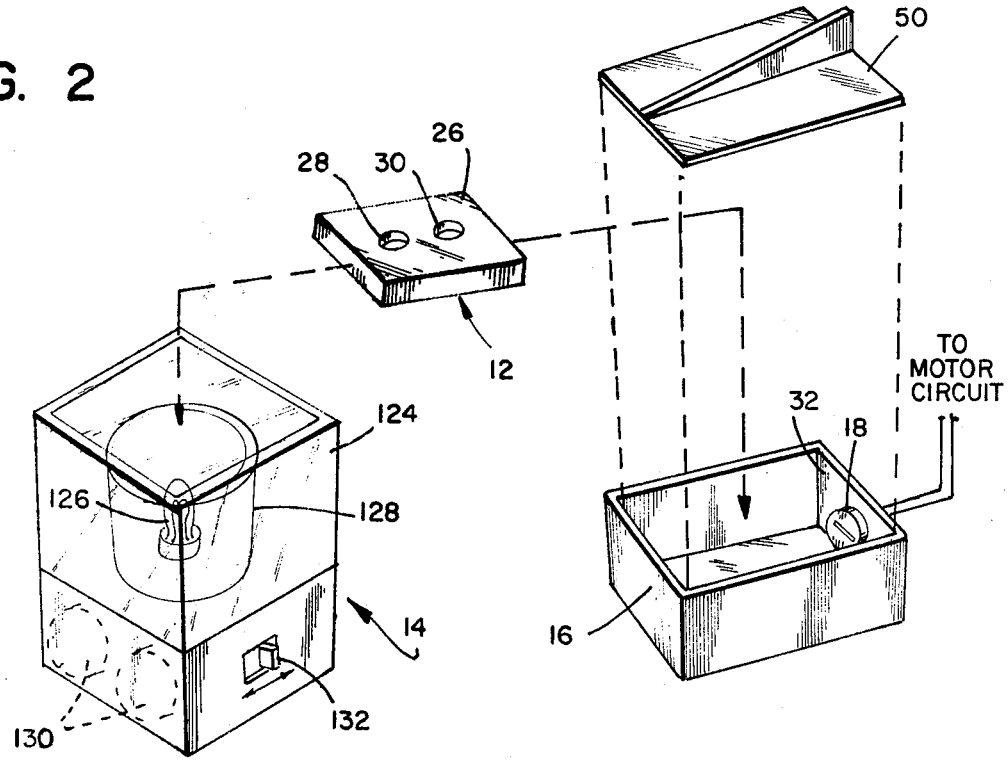
FIG. 2 is an exploded view showing various components of the photoemissive motor control system of FIG. 1 and showing a phosphorescent block mounted alternatively in a chamber which is part of the toy automobile of FIG. 1 or in an activation apparatus.

Referring in detail to the drawings, there is shown in FIGS. 1 and 2 the major components of a toy apparatus 10, which includes a photoemissive motor control system made in accordance with the present invention. The photoemissive motor control system comprises a phosphorescent member 12 which may be exposed to light in an activator assembly 14 and then inserted into a chamber 16 to act on a light dependent resistor 18 in order to activate an electrical circuit and drive a motor 20. As is shown in FIG. 1, the chamber 16 is located in the engine compartment 22 of a toy automobile 24, which forms the primary embodiment of the invention.

The phosphorescent member 12 comprises a block of epoxy or similar material which is impregnated with phosphorescent or luminescent powder of the well-known type which is adapted to glow and emit visible light for a short period of time, after having been exposed to visible light radiation. The block 12 has opposed flat faces 26 through which extend a pair bores or apertures 28 and 30, the use of which will be described presently. When activated by exposure to light and placed in the chamber 16, photoemission from the phosphorescent member 12 acts on the light-dependent resister 18 which is mounted in the rear wall 32 of the chamber 16.

The general construction of the toy automobile 24 is conventional and is of the type found in battery driven toy automobiles presently available on the market. The overall arrangement of the various components within the body of the toy automobile is shown in FIG. 3. The electric motor 10 is energized by batteries 34, 36 and 38 which are connected in series, the motor 20 having a drive shaft 40 coupled to the vehicle wheels 42 through a gear box 44, drive gear 46, and further gearing (not shown). The toy automobile 24 may also include mechanism for reversing the motor 20, steering the front wheels, reversing the direction of motion when the automobile strikes an obstruction or comes to the edge of a table, etc., which mechanism is not illustrated since it forms no part of the present invention.

The toy automobile 24 has a hinged hood 48 which may be lifted in the manner shown in FIG. 1 to expose the interior of the engine compartment 22 and provide access to the chamber 16 which is in the form of an open-top box having an interior of black color. The chamber 16 is normally closed at its open top end by a removable cover 50 which may be lifted to enable the phosphorescent member 12 to be inserted into and removed from the chamber 16 in the manner shown in FIG. 2. The cover 50, when inserted, maintains the interior of the chamber 16 in darkened condition and insures that the light-dependent resister 18 is not energized by ambient light.

As shown in FIG. 3, a slide switch 52 is mounted on the body of the toy automobile 24 and is selectively actuated to connect and disconnect the batteries 34, 36 and 38 from the motor 20. A push switch 54 is also mounted in engagement with the hinged hood 48 and is adapted to be brought to an open position to interrupt the battery circuit when the hood 48 is raised, thereby preventing inadvertent operation of the toy automobile when the hood 48 is in raised position.

In FIG. 3, which is partially schematic, it will be seen that the batteries 34, 36 and 38 are connected in series by leads 56 and 58, with one end of the series connected by lead 60 to one terminal of the motor 20. The other terminal of the motor 20 is connected by lead 62 to a printed circuit board 64 containing the circuit elements shown in FIG. 6. The printed circuit board is connected by leads 66 and 68 to the light dependent resistor 18, and is also connected by leads 70, 72 and 74, through switches 52 and 54, to the other side of the battery series.

FIG. 6 shows schematically the circuit components of the printed circuit board 64 and the manner in which the circuit connects the battery power source to the motor 20, under the control of light dependent resistor 18. In this view it will be seen that the light dependent resistor (LDR) 18 is connected to a source of direct current voltage, such as the batteries 34, 36, 38, having a preferred range of three to nine volts, via lead 66, and to a variable resistor 76 via a lead 68. As intermediate portion of the lead 68 is connected to the base of an NPN transistor 80 via a lead 82. The collector of the NPN transistor 80 is connected to the positive terminal 78 of the power source via a lead 84 and the emitter is connected to a resistor 86 via a lead 88. The resistor 86 is connected to a resistor 90 via a lead 92. An intermediate portion of the lead 92 is connected to the gate of a silicon controlled rectifier (SCR) 94 via a lead 96; the anode of which is connected to one terminal of the direct current motor 20 via lead 62. The other terminal of the motor 20 is connected to the positive terminal 78 of the power source via lead 60. The slider 102 of the variable resistor 76, the resistor 90, and the cathode of the SCR 94 are each connected to ground 104, via the respective leads 106, 108 and 110. The variable resistor 76 has preferred resistance value of one megohm and the resistors 86 and 90 each have a preferred resistance value of one kilohm.

When the light dependent resistor (LDR) 18 is receiving no light from the phosphorescent member 12, transistor 80 is non-conductive and hence SCR 94 is non-conductive. Therefore, there is no current flow through motor 20 and the toy automobile 24 is not driven.

When the glowing phosphorescent member is inserted into the chamber 16, it illuminates the LDR 18 to reduce the resistance of the latter and thereby raise the voltage applied to the base of transistor 80, causing the latter to conduct. The variable resistor 76 is provided in order to selectively vary the voltage to be applied to the base of transistor 80 when LDR 18 is illuminated. Conduction of transistor 80 causes a voltage to be applied to the gate of SCR 94 in accordance with the ratio between the resistance values of resistors 86 and 90.

The aforementioned application of voltage to the gate of SCR 94 causes the latter to conduct, thereby completing the series connection of motor 20 to the positive power source terminal 78 and ground 104. The motor 20 is thereby energized and the toy automobile 24 is driven.

When the phosphorescence of block 12 dissipates below a predetermined level and the amount of light received by the LDR 18 is correspondingly reduced, the increased resistance of LDR 18 causes the voltage applied to base of transistor 80 to be reduced sufficiently to cause transistor 80 to be non-conductive. In this condition SCR 94 is also rendered non-conductive and the supply of current to motor 20 is thereby interrupted.

In operation of the toy automobile 24, the user first deactivates the drive circuit by moving the switch 52 to its "off" position, then raises the hood 48 and removes the cover 50 from chamber 16 to expose the phosphorescent member 12. A pair of tweezers (not shown) is supplied with the toy automobile for gripping the phosphorescent member 12 and removing it from the chamber 16. The member 12 is gripped by inserting the tweezers into the apertures 28 and 30, and is lifted out of the chamber 16, simulating the usual handling of a radioactive block by means of tongs. The phosphorescent member 12 is then exposed to sunlight, to bright artificial light, or to the activator assembly 14, and is then replaced in the chamber 16, using the pair of tweezers. The chamber cover 50 is replaced, the hood 48 closed, and the slide switch 52 is moved to its "on" position. The phosphorescence of member 12 acts upon the light dependent resistor 18 within chamber 16, thereby energizing the motor 20 and driving the toy automobile. After a period of time the phosphorescence of the member 12 dissipates, and the toy automobile stops moving. This simulates the dissipation of a radioactive fuel element and the need for reenergization. The phosphorescent member 12 is therefore removed from the toy automobile, exposed to light, and then replaced, utilizing the pair of tweezers as described above.

The incorporation of the photoemissive motor control system according to the present invention within a toy automobile has been shown by way of example only. It is understood that this system may be incorporated in any one of a number of diverse types of toys with equal success. Another example of such a toy apparatus is the toy robot figure 112 shown in FIG. 4.

The toy robot figure 112 includes an integral back pack 114 which contains batteries, and a cylindrical chest cavity 116 into which slides a removable drawer 118, shown in FIG. 5. The drawer 118 has an enlarged circular front wall 120 and a recessed portion 122 into which the phosphorescent member 12 may be inserted during operation. When the phosphorescent member 12 is inserted in the drawer 118 and the drawer is closed, the phosphorescent member 12 acts upon a light dependent resistor 18 which is mounted within the chest cavity 116 and is connected to an electrical circuit for operation of a motor (not shown) mounted within the body of toy robot figure 112. The motor drives the arms and/or legs of the figure, in a known manner to provide animation, and the circuit also causes the eyes and the simulated laser gun to flash. The circuit may be of the type shown in FIG. 6 for operation of the motor, but since the light bulbs employed constitute loads which draw a continuous, uninterrupted current, the circuit employed is preferably one which substitutes a transistor as the switch, instead of the SCR. This is because of the inherent latching property of the SCR.

The phosphorescent member 12 may be activated by exposure to sunlight, to ambient room illumination or by using the activation apparatus 14 shown in FIG. 2. The activation apparatus 14 includes a hollow housing 124 made of transparent plastic material within which is mounted a battery-operated lamp 126, surrounded by a transparent plastic cylinder 128 and simulating a radioactivity generator. The housing 124 also contains a pair of batteries 130 which are electrically connected to the lamp 126 through an on-off switch 132.

The lamp 126 is of the conventional flasher type, having a built-in flasher mechanism which operates to cause the bulb to flash intermittently after a designated time period. When the switch 132 is closed to connect the lamp 126 to the batteries 130, the lamp 126 is illuminated with a steady glow for a predetermined time period, for example ten seconds, after which the flasher mechanism has become heated sufficiently to cause the lamp to begin flashing.

In use of the activation apparatus 14, the phosphorescent member 12 is placed upon the top transparent wall of the housing 124, immediately above the lamp 126, as indicated in FIG. 2. The switch 132 is then actuated to cause the lamp 126 to be illuminated with a steady glow. After a short period of time, the lamp 126 begins to flash, indicating to the user that the member 12 is fully charged and may be placed within the toy automobile 24 or toy robot figure 112 for driving the latter. The lamp 126 therefore serves as timer means for indicating that the phosphorescent member has been sufficiently exposed to the light.

While preferred embodiments of the invention have been shown and described herein, it is obvious that numerous omissions, changes and additions may be made in such embodiments without departing from the spirit and scope of the invention.

What is claimed is:

1. A photoemissive control system for a toy apparatus having a body portion, comprising a photoemissive phosphorescent member, an enclosed chamber within said body portion and sized to receive said phosphorescent member therewithin, light dependent means mounted within said chamber for producing an electrical output in response to impingement thereon of a predetermined value of photoemission from said photoemissive fluorescent member, electrical load means mounted in said toy apparatus and operative to provide an output in response to electrical energization, direct current power source means, and electrical circuit means connecting said light dependent means, said power source, and said electrical load means for energizing said load means when said phosphorescent member is placed in said chamber after exposure to light, said light dependent means being adapted to render said load means inoperative when photoemission from said phosphorescent member drops below said predetermined value.

2. A photoemissive control system according to claim 1 in which said electrical load means comprises an electric motor.

3. A photoemissive control system according to claim 2 in which said electrical circuit means includes switching means operative in response to the output of said light dependent means to electrically connect said motor to said power source for energization of said motor.

4. A photoemissive control system according to claim 3 in which said switching means comprises a gate controlled rectifier in series with said motor and said power source.

5. A photoemissive control system according to claim 4 in which said light dependent means comprises a light sensitive resistor having a resistance which decreases in response to impingement of light on said resistor.

6. A photoemissive control system according to claim 5 in which said electrical circuit means also includes a variable resistor in series with said light sensitive resistor and said power source for selectively varying said predetermined value of light impingement at which said variable resistor produces said output.

7. A photoemissive control system according to claim 1 in which said toy apparatus comprises a toy automobile.

8. A photoemissive control system according to claim 1 in which said toy apparatus comprises a toy robot figure.

9. A photoemissive control system according to claim 1 in which said phosphorescent member comprises a block of expoxy material impregnated with phosphorescent powder.

10. A photoemissive control system according to claim 1 which further includes an activation apparatus comprising a transparent housing, a battery-operated lamp mounted in said housing, means for removably mounting said phosphorescent member on said housing adjacent to said lamp, a battery power supply mounted in said housing, switch means connecting said battery power supply to said lamp for continual energization of said lamp, and timer means for interrupting the continuous energization of said lamp after a predetermined time period.

* * * * *